US005657948A

United States Patent [19]

Roucoux

[11] Patent Number: 5,657,948

[45] Date of Patent: Aug. 19, 1997

[54] CONTROL OF A PROJECTILE BY MULTI-CHAMBER AND SINGLE-NOZZLE IMPELLER

[75] Inventor: Bertrand Roucoux, Saint Jean le Blanc, France

[73] Assignee: TDA Armements SAS, La Ferte St Aubin, France

[21] Appl. No.: 590,905

[22] Filed: Jan. 24, 1996

[30] Foreign Application Priority Data

Feb. 3, 1995 [FR] France ..... 95 01268

[51] Int. Cl.[6] ..... F42B 10/66

[52] U.S. Cl. ..... 244/3.22; 102/381

[58] Field of Search ..... 244/3.21, 3.22; 102/374, 381; 60/225

[56] References Cited

U.S. PATENT DOCUMENTS

| | | | |
|---|---|---|---|
| 3,141,635 | 7/1964 | Davis et al. | 244/3.22 |
| 4,408,735 | 10/1983 | Metz | 244/3.22 |
| 4,413,795 | 11/1983 | Ryan | 244/3.22 |
| 4,632,336 | 12/1986 | Crepin | 244/3.22 |
| 4,803,925 | 2/1989 | Buchele-Buecher | 244/3.22 |
| 5,123,611 | 6/1992 | Morgand | 244/3.22 |
| 5,129,604 | 7/1992 | Bagley | 244/3.22 |
| 5,238,204 | 8/1993 | Metz | 244/3.22 |
| 5,433,399 | 7/1995 | Becker et al. | 244/3.22 |

FOREIGN PATENT DOCUMENTS

| | | |
|---|---|---|
| 1 426 963 | 12/1965 | France . |
| 2 251 834 | 7/1992 | United Kingdom . |

*Primary Examiner*—Michael J. Carone
*Assistant Examiner*—Theresa M. Wesson
*Attorney, Agent, or Firm*—Oblon, Spivak, McClelland, Maier & Neustadt, P.C.

[57] ABSTRACT

The disclosure pertains to a projectile guided by successive lateral gas jets by way of pairs of impellers. The impellers of one pair are fired so as to exert opposite moments of rotation. According to the disclosure, the impellers are brought together in two groups. Of the impellers of one pair, one is in one group and the other is in the other group. The impellers of each of the groups are separated by diode bulkheads that withstand the pressure of the impeller that is located on one side of the bulkhead and is fired first, but does not withstand the firing of the impeller that is located on the other side of the bulkhead and is fired second. The impellers of one group lead into one and the same nozzle. Thus, the making of the guidance impellers is simplified at the same time as the control of the guidance is improved.

1 Claim, 3 Drawing Sheets

SECTION B-B

SECTION A-A

CONTROL OF A PROJECTILE BY MULTI-CHAMBER AND SINGLE-NOZZLE IMPELLER

BACKGROUND OF THE INVENTION

1. Field of the Invention

The invention relates to the field of projectiles with trajectory correction by lateral gas jets.

2. Description of the Prior Art

Devices to achieve corrections of this kind are already known in the prior art. They may be classified under two categories. The first category comprises devices for which the axis of the lateral gas jet passes through the center of gravity of the projectile. These trajectory correctors do not, in principle, induce any moment of force in the projectile. They enable the function of attitude control under force. The modification of trajectory results from the composition of the axial velocity of the projectile and the lateral velocity resulting from the guiding gas jet. The only action affecting the orientation of the axis of the projectile arises when the projectile takes an angle of incidence following the variation of the velocity vector. The axis of the projectile gets reoriented in parallel to the velocity vector after a period of oscillations that depends on the aerodynamic stability of the projectile and the duration of the guiding impulse.

The second category of trajectory correctors using gas jets comprises projectiles in which the gas jets convey a moment of rotation to the projectile. The greater the lever arm of the gas jets, which can be likened to the distance between the point of application of the lateral jet and the center of gravity of the projectile, the greater is this rotation. In order to make the rotation stop at the desired position, there is provided a second gas jet exerting a moment opposite to the first one. The values of the lever arm, the total impulse and the instance of firing of each impeller, which are set on the basis of the characteristics of the projectile, enable, in principle, the following factors to be controlled all at once:

the cancellation of the angular velocity of the projectile;

the deviation of the velocity;

the angular position (yaw and pitch) of the projectile.

For the guidance, therefore, a juxtaposition of pairs of impellers is made, their number being given by the maximum number of guidance corrections envisaged.

The impellers may be laid out longitudinally as shown in FIG. 1. This figure gives a schematic view of a longitudinal section of a projectile. The impellers are laid out along the longitudinal axis by pairs of impellers a, a', b, b', and c, c'.

The impellers of each pair are laid out on either side of the center of gravity G of the projectile.

The condition of cancellation of the angular velocity of the projectile dictates the following relationship between the parameters of the same pair of impellers;

$$It1\ L1=It2\ L2$$

with

It1, It2: total impulse delivered by each impeller;

L1, L2: lever arm of each impeller.

It may be recalled that the total impulse is the integral in time of the force delivered by the impeller during its operation. Should the forces F1 and F2 of the two impellers be substantially constant, the following are obtained:

$$It1 \sim F1\ t1$$

$$It2 \sim F2\ t2$$

where t1, t2 are the combustion times of the impellers.

Thus, for an equal lever arm, the impellers of the same pair may be identical. Most generally, the total impulse of each impeller is inversely proportional to the lever arm.

The deviation of the velocity for a guidance correction imposes a value on the sum of the total impulse values for each pair of impellers;

giving It, the sum of the total impulse values. We have:

$$It=It1+It2$$

The value of the total impulse of each impeller (It1, It2) is deduced therefrom as a function of the lever arms (L1, L2), and of It:

$$It1=It\ (L1/(L1+L2))$$

$$It2=It\ (L2/(L1+L2))$$

The angular position, yaw and roll, after correction, depends on the preceding parameters (It, L1, L2), and the firing sequence of the two impellers used for this correction.

It is generally laid down that the two impellers should never be in operation at the same time, in order to prevent excess lateral load factor and couplings (interaction between the jets) between the effects of the two impellers.

The limit therefore is that the firing of the second impeller must follow the extinction of the first one.

In this case, there is a maximum value of the lever arm, depending on the angle (yaw and roll) that must be taken by the projectile, on the inertia and on the total impulse It.

This maximum value may be reached for impellers that are at a distance from the center of gravity G. This fact makes this approach impossible or makes it necessary, for example, to diminish the amplitude of the guidance corrections asked for, to the detriment of the performance values.

For this reason, the impellers that are at a distance from the center of gravity G are shown in FIG. 1 as being smaller than the near impellers.

In other known embodiments, impellers exerting a moment of rotation on the projectile are laid out in a radial position.

This mode of layout is shown schematically in FIGS. 2*a*, 2*b* and 3*a*, 3*b*. Each of these figures shows a longitudinal sectional view of a projectile section (FIGS. 2*b* and 3*b*) and a cross-section made on a round element d, comprising impellers positioned radially (FIGS. 2*a* and 3*a*).

The round elements d, d' are positioned on either side of the center of gravity G of the projectile. The lever arm of each of the impellers are then identical and the impellers e, e' may be identical.

This type of layout has several drawbacks. The volume available for each of the impellers is limited to the portion of angular sector devoted in each of the round elements d, d' to each of the impellers, for example PI/3 for a round element having six impellers as shown in FIG. 2*a* or 3*a*. It may be sought to compensate for this constraint by increasing the length of the propulsive charge of each of the impellers. However, there soon arise constraints dictated by the section of the gas passage which must be sufficient throughout the length of the charge in order to prevent erosive combustion.

It may be noted that this minimum section increases from the charge side opposite the nozzle up to the charge side near to the nozzle hence in the direction of the discharge of the combustion gases. The filling rate (the volume of the charge with respect to the volume of the combustion chamber of the impeller) is then penalized.

Furthermore, whatever the shape of the impellers, the volume of the round element cannot be used in an optimum manner. This penalizes the mass balance. If the section of the combustion chamber is circular as shown in FIG. 2*a*, the penalizing of the mass balance results from of the unused volumes between the impellers. If the shape of the section of the impellers is petal-shaped as shown in FIG. 3*a*, it is more difficult to make precisely because of the shape, and there are concentrations of stresses on the walls which must be supported by the local addition of matter, which also penalizes the mass balance.

In the face of these prior art approaches, the present invention is aimed at a projectile guided by means of gas jets having both the advantages of the round element arrangement as shown in FIGS. 2*a*, 2*b* or 3*a*, 3*b* and those of the longitudinal arrangement as shown in FIG. 1 without having the drawbacks of either arrangement.

Advantageously, the guided projectile according to the invention has only two nozzles, one on each side of the center of gravity and a plurality of impellers distributed in pairs. For each pair of impellers, one impeller emits its gases by one of the nozzles and the other by the second nozzle.

Since there are only two nozzles the lever arms are identical for each of the corrections.

The reduction of the number of nozzles is an obvious advantage with respect to their integration into the projectile.

First of all, the entire available section of the projectile (generally the circular section except for the central core) can be used to make the impeller. The cylindrical shapes that result therefrom are simple shapes that can be easily made and provide for high mechanical strength (resistance to pressure).

Furthermore, while the sum of the volume of the chambers of the embodiment according to the invention remains close to the sum of the volumes of the chambers of several impellers, a major gain is obtained from the number of nozzles. This number can be reduced to two. It may even be advantageous to increase their size to increase the thrust delivered and thus improve the performance characteristics (or reduce the pyrotechnic charge mass).

The identical lever arm of each of the sets prevents the restrictions laid down on the impellers located far from the center of gravity in embodiments of the type with "longitudinal layout of impellers".

It may be recalled that, to the value of total impulse dictated by the guidance performance characteristics (action on velocity), there corresponds a maximum value of the lever arm. In the proposed approach, the only constraint laid down as regards the mechanical design of the projectile is therefore the longitudinal position of two nozzles. It would appear that this constraint can be easily complied with.

Furthermore, in applications to projectiles driven by a rolling velocity, the proposed approach is always quite appropriate.

Indeed, if the projectile has a rolling velocity, the duration of operation of the impellers must be small so as not to "average" the correction on an excessively great roll angle (a correction on one rotation is wholly ineffective). In this case, the total impulse needed for a guidance must be obtained:

either by increasing the thrust;

or by splitting up the thrust among several corrections.

The increase of the thrust (with total impulse maintained) has little affect on the quantity of pyrotechnic charge but above all modifies its surface area and its combustion speed. However, it calls for an increase in the gas flow rates, hence an increase in the size of the nozzles. The proposed approach comprising only two nozzles is consequently quite appropriate.

The splitting up of the thrust is also easier with the proposed approach than with prior art approaches: the splitting up relates only to two impellers as compared with twice the number of guidance corrections in the other approaches.

SUMMARY OF THE INVENTION

The invention therefore relates to a projectile having a longitudinal axis XX', a center of gravity G and provided with guidance impellers distributed among n pairs, each pair comprising a first and a second impeller, each first impeller leading into a nozzle located in front of the center of gravity G of the projectile and each second impeller leading into a nozzle located behind the center of the gravity of the projectile, each of the impellers having a combustion chamber, wherein the set of the first impellers of a pair forms a first group of impellers to which the impellers belong, the set of second impellers of a pair forms a second group of impellers to which the impellers belong, the combustion chambers of the impellers in each of the groups being separated from one another by a diode bulkhead having two faces, a first face and a second face, this bulkhead being resistant when its first face is put under a pressure substantially greater than that exerted at the same time on its second face and yielding when its second face is put under a pressure substantially greater than that exerted at the same time on its first face, the combustion chambers of each of the impellers of a group being in direct communication for one of the impellers and by means of one or more diode bulkheads for each of the other impellers of the group with a single nozzle for the group, the nozzle of the impellers of the first group being before the center of gravity G and the nozzle of the impeller of the second group being behind the center of gravity G.

BRIEF DESCRIPTION OF THE DRAWINGS

An exemplary embodiment shall be described with reference to the appended drawings, of which.

DESCRIPTION OF THE PREFERRED EMBODIMENT

Figure 1:
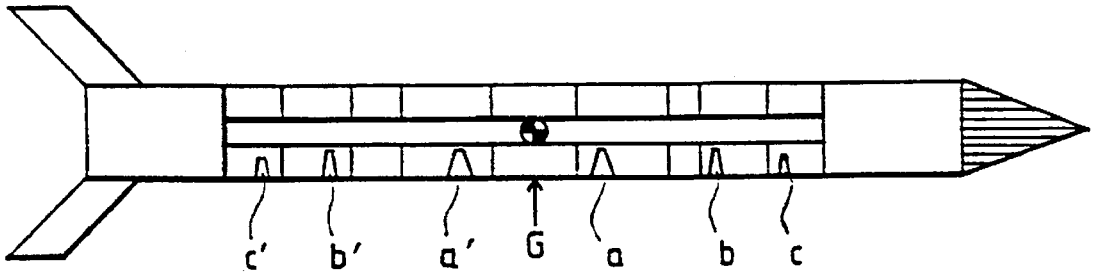
FIGS. 1, 2*a*–2*b* and 3*a*–3*b* show conventional arrangements.
Figure 2A:
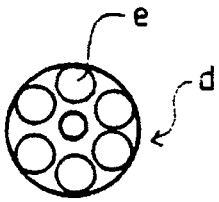
Figure 2B:
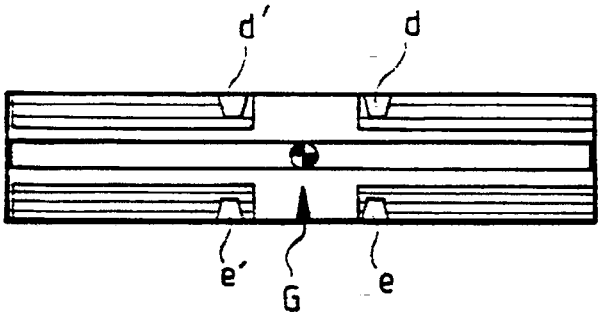
Figure 3A:
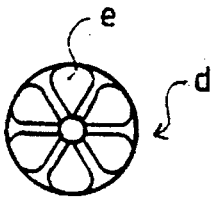
Figure 3B:
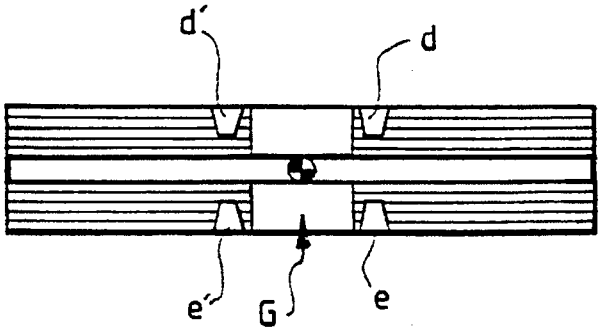
FIG.3b PRIOR ART
Figure 4:
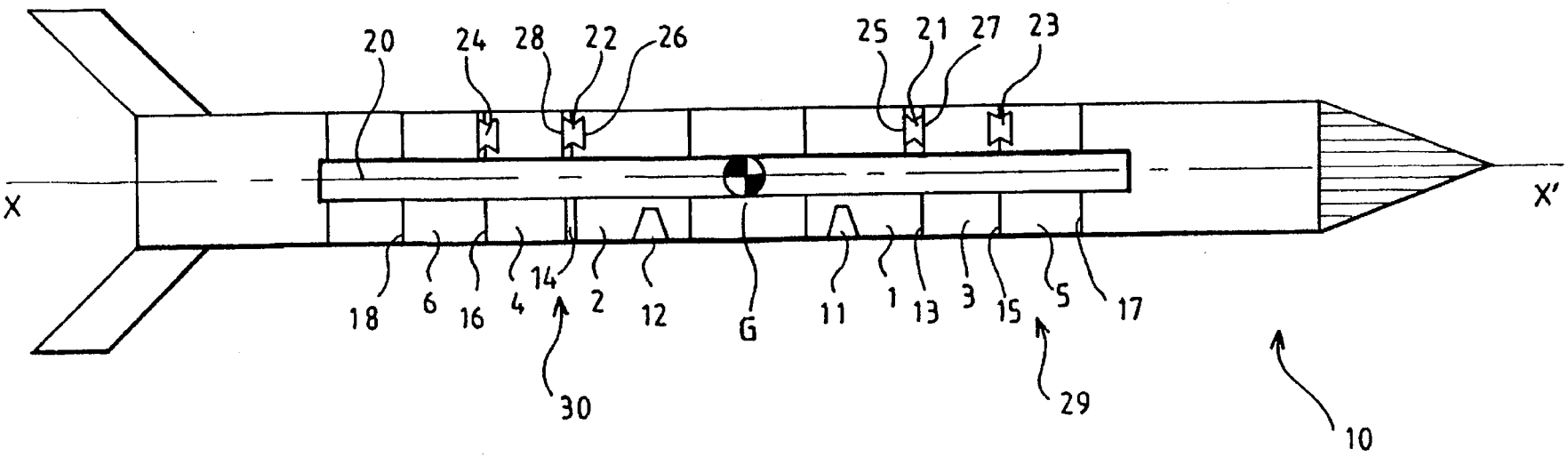
FIG. 4 shows a longitudinal sectional view of a projectile comprising two groups of impellers each leading into a single nozzle.

FIG. 4 shows the preferred embodiment. It is a projectile 10 of which only the part pertaining to the guidance by impeller shall be described here below.

The projectile, on either side of the center of gravity G, has two groups 29, 30 of guidance impellers.

In the case shown, they are ring-shaped impellers taking up the entire section of the projectile except for the central channel 20. Each group of impellers 29, 30 has three impellers 1, 3, 5 for the group 29 and 2, 4, 6 for the group 30. Each of the impellers 1 and 2 has a nozzle 11, 12 respectively. The gases produced by the impellers 1, 3, 5 of the group 29 flow into the nozzle 11 located before the center of gravity G of the projectile. The gases produced by the impellers 2, 4, 6 of the group of impellers 30 flow into the nozzle 12 located in the rear of the center of gravity G of the projectile 10. The impellers 1 and 2 which are the closest to the nozzles 11 and 12 respectively have been shown as being slightly bigger owing to the presence of the nozzle and the shape of the combustion chamber designed to canalize the gas jet towards the nozzle. The rear part of a impeller is the part close to the nozzle, the front part is the one that is distant from the nozzle. Thus, for the impeller 11, the front part of the impeller is the one in front of the projectile. For the impeller 12 positioned symmetrically to the impeller 11 with respect to a transversal plane going through the center of gravity G, the rear part is further in front of the projectile than the front part of the impeller. The latter is further to the rear of the projectile. Each impeller in this case has a double side wall formed by an internal side wall surrounding the central channel 20 and an external side wall close to the external side wall of the projectile. These two wall parts are cylindrical and centered on the axis XX' of the projectile. Each impeller also has a rear partition 13, 15, 17 for the impellers 1, 3, 5 of the group 29 and 14, 16, 18 for the impellers 2, 4, 6 of the group 30.

The rear partitions 13, 15 and 14, 16 between the impellers 1 and 3, 3 and 5, 2 and 4, and 4 and 6 respectively are each provided with a diode back or diode bulkhead 21, 23 and 22, 24 respectively. It may be noted that the term "diode" as used within the context of the present invention is analogous with the functioning of the element usually called a diode. The characteristics of the diode bulkheads are identical and shall be commented upon hereinafter for the diode bulkheads with which the partitions 13 and 14 are equipped. Each of the diode bulkheads 21 and 22 has a rear face 25, 26 respectively pointed towards the rear of the impellers 1 and 2 respectively and a front face 27, 28 pointed towards the front of the impellers 1 and 2 respectively. The rear partitions 13 and 15 separate the impellers 1, 3 and 3, 5 respectively. The rear partitions 14, 16 separate the impellers 2, 4 and 4, 6 respectively. The rear faces 25, 26 of the diode bulkheads 21, 22 are pointed towards the interior of the impellers 1 and 2 respectively. The front faces 27, 28 of the bulkheads 21, 22 are pointed towards the interior of the combustion chambers of the impellers 3 and 4 respectively. The diode bulkheads 21 and 22 withstand pressure exerted on their faces 25, 26 respectively, namely pressure is present in the combustion chamber of each of the impellers 1 and 2 respectively.

By contrast, in a way that is known, for example from the patent EP 0 312 139, these diode bulkheads do not withstand pressure exerted on their face 27, 28 respectively, namely pressure present within the combustion chambers of the impellers 3 and 4 respectively. This is also the case for the diode bulkheads 23 and 24 which withstand a pressure exerted in the combustion chambers of the impellers 3 and 4 respectively but yield to a pressure exerted on their opposite face in the combustion chambers of the impellers 5 and 6 respectively.

An exemplary layout of a diode bulkhead for example between the impellers 4 and 2 of FIG. 4 shall now be explained with reference to FIGS. 5 to 7.

Figure 5:
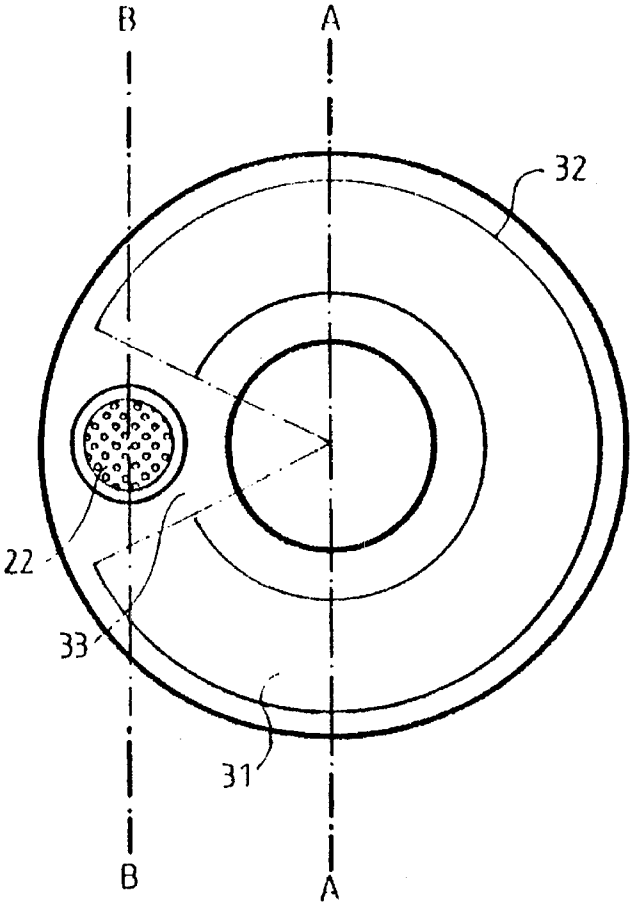
FIG. 5 shows a cross-section made at the level of a firing device of a impeller.
Figure 6:
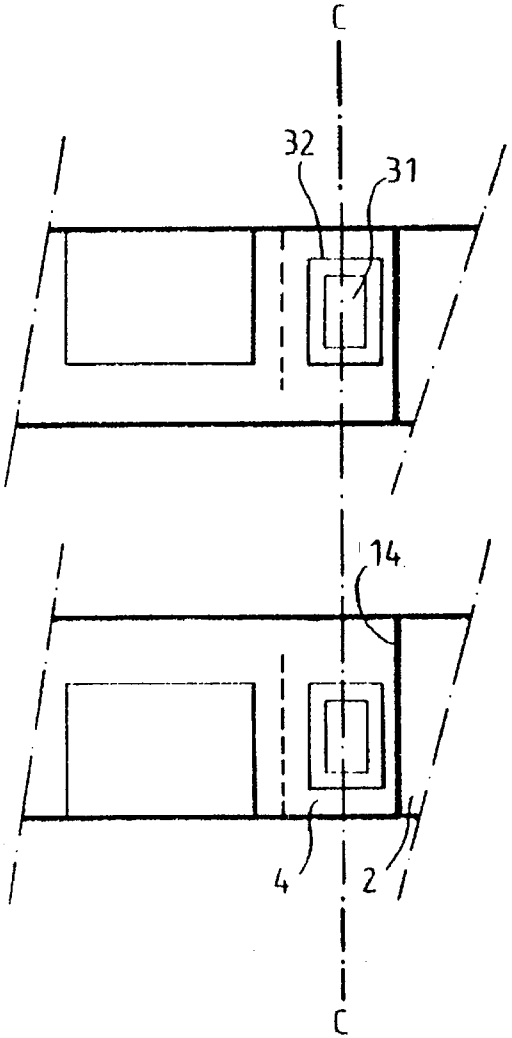
FIG. 6 shows an axial longitudinal sectional view made along the line AA of FIG. 5.

FIG. 5 shows a cross-section for example of the impeller 4 made in the rear of this impeller at the level of the diode bulkhead 22, represented by the line CC of FIG. 6.

The diode bulkhead 22 is located in the angular sector whose volume is not occupied by the propellant 31 of a firing device 32. The propellant 31 of this firing device has the shape of an incomplete ring so as to set up an angular sector 33 that is devoid of propellant. The diode bulkhead 22 is set up in this angular sector in the rear partition 14 of the impeller 4.

The operation is as follows. When a trajectory correction is necessary, the impeller 1 for example is fired. It prompts a rotation of the projectile on itself. To stop this rotation, the impeller 2 is then fired. In the projectile shown in FIG. 4, the nozzles 11 and 12 have been shown with the same angular rolling position. This arrangement however makes it possible, in a known way described for example in the U.S. Pat. No. 4,408,735 filed on behalf of the present Applicant, to modify the pitching or yawing orientation by taking advantage of the residual rolling rotation always present on a projectile. The diode bulkheads 21 and 22 withstand the pressure exerted in the combustion chamber of the impellers 1 and 2 respectively. When a new guidance correction is necessary, the impeller 4 for example is fired and then, to stop the rotation, the impeller 3 is fired. The diode bulkheads 21, 22 yield beyond a predetermined pressure. This pressure is chosen to be greater than the pressure needed to fire the impeller since, owing to the firing of the impellers 1 and 2, the firing the interior percussion caps for the firing of the nozzles 11 and 12 are no longer present. When the bulkheads 21 and 22 have yielded, the combustion gases from the impellers 3 and 4 respectively may escape by the nozzles 11 and 12 through the combustion chamber of the impellers 1 and 2 respectively. The operation is the same for the impellers 5 and 6 respectively which will be used for the third correction.

Naturally, the invention is not limited to the mode shown in FIG. 4. The number of pairs of impellers may be different. The central ring-shaped channel 20 is not obligatory. The circular-sectioned shapes have been chosen as a function of their ease of manufacture where other shapes are possible. The nozzles have been placed relatively close to the center of gravity with lever arms of the same length, but it is possible to envisage unequal arms with different total impulse values for the impellers of each of the groups.

Figure 7:
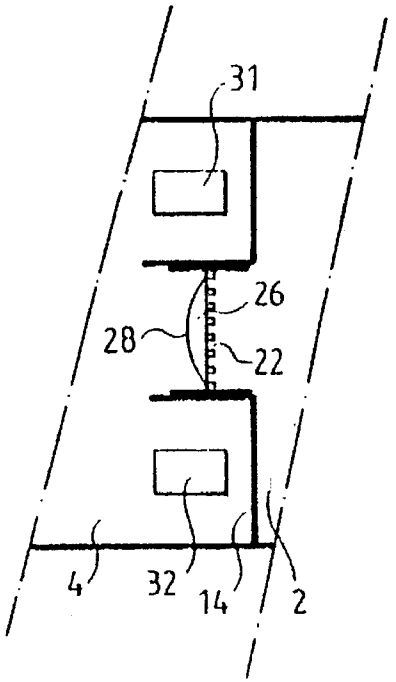
FIG. 7 shows a longitudinal sectional view made at the level of the line BB of FIG. 5.

Similarly, the layout of the diode bulkhead as shown in FIGS. 5 to 7 is suited to a projectile in which the equipment is laid out in a central channel 20. With another impeller architecture, for example a cylindrical one, laid out along the axis of the projectile, the diode bulkhead could occupy the center of the impeller.

What is claimed is:

1. A projectile comprising:

a longitudinal axis, a center of gravity, a first group of guidance impellers having first impellers, and a second group of guidance impellers having second impellers;

wherein:

a first one of said first impellers leads into a first nozzle located in front of the center of gravity of the projectile, and a first one of said second impellers leads into a second nozzle located behind the center of gravity of the projectile;

each of said first impellers of said first group of guidance impellers and said second impellers of said second group of guidance impellers comprises a combustion chamber, such that each of the combustion chambers for adjacent ones of said first impellers and adjacent ones of said second impellers are separated from one another by a diode bulkhead;

each of said diode bulkheads has a first face and a second face, such that each of said diode bulkheads is adapted to withstand a pressure exerted on its first face that is substantially greater than a pressure exerted at the same time on its second face, and to yield when a pressure exerted on its second face is substantially greater than a pressure exerted at the same time on its first face, so as to provide for a direct communication between combustion chambers of adjacent ones of said first impellers and between combustion chambers of adjacent ones of said second impellers.

* * * * *